US012173459B2

(12) United States Patent
Jones et al.

(10) Patent No.: US 12,173,459 B2
(45) Date of Patent: Dec. 24, 2024

(54) COLLAPSIBLE BARRICADE

(71) Applicants: Prentiss Jermale Jones, Laurel, MD (US); Walter Jesus Rivero, Hanover, MD (US)

(72) Inventors: Prentiss Jermale Jones, Laurel, MD (US); Walter Jesus Rivero, Hanover, MD (US)

( * ) Notice: Subject to any disclaimer, the term of this patent is extended or adjusted under 35 U.S.C. 154(b) by 317 days.

(21) Appl. No.: 17/745,835

(22) Filed: May 16, 2022

(65) Prior Publication Data

US 2022/0364319 A1 Nov. 17, 2022

Related U.S. Application Data

(60) Provisional application No. 63/188,697, filed on May 14, 2021.

(51) Int. Cl.
*E01F 13/02* (2006.01)

(52) U.S. Cl.
CPC ..... *E01F 13/02* (2013.01)

(58) Field of Classification Search
CPC . E01F 9/688; E01F 13/00; E01F 13/02; E01F 13/022; E01F 13/028
USPC ..... 404/6; 256/13.1, DIG. 2; 116/63 P; 40/610
See application file for complete search history.

(56) References Cited

U.S. PATENT DOCUMENTS 2,167,564 A * 7/1939 Fonda ..... E01F 9/688 40/607.1
2,483,263 A * 9/1949 Cummings ..... A47B 43/00 211/130.1
2,558,944 A * 7/1951 Emmerson ..... E01F 9/688 116/63 P
2,710,474 A * 6/1955 Hynek ..... B60Q 7/005 40/610
2,844,897 A * 7/1958 Vance, Jr. ..... E01F 9/688 40/610
3,321,742 A * 5/1967 Nunn, Jr. ..... E01F 13/02 340/331
3,917,232 A 11/1975 Lindner
4,372,536 A 2/1983 Morse
4,863,138 A * 9/1989 Dicke ..... E01F 9/688 40/608
4,888,894 A * 12/1989 Brown, Jr. ..... E01F 9/688 40/610
6,705,796 B2 3/2004 Lund
6,880,278 B1 * 4/2005 Connors ..... E01F 13/02 40/605
8,794,866 B2 * 8/2014 Petryshyn ..... E01F 13/085 404/6
9,096,978 B2 * 8/2015 Carlson ..... E01F 13/028

FOREIGN PATENT DOCUMENTS

DE 4322988 A1 * 1/1995 ..... E01F 9/688

OTHER PUBLICATIONS

Pexco, Break-away Traffic Barricades, pexco.com, Mar. 2020.

* cited by examiner

*Primary Examiner* — Josh Skroupa

(57) ABSTRACT

A barricade that comprises vertical supports with a first section, second section and a telescopic base hingedly connected together is provided. The present invention further includes base legs pivotally mounted to the bottom of the vertical supports and a plurality of chevron boards attached to the vertical supports.

18 Claims, 7 Drawing Sheets

COLLAPSIBLE BARRICADE

FIELD OF THE INVENTION

The present invention relates generally to a collapsible traffic or construction barricade. More specifically, the present invention is a barricade with retractable base and upright members that can be interchangeable.

BACKGROUND OF THE INVENTION

Traffic and construction barricades are commonly used to warn oncoming vehicles and pedestrians of a potential danger or roadway change. Traffic barricades come in various different shapes and sizes and can be designed with a fixed or portable design usually with one to three marked railings. These traffic barricades are used to control traffic by blocking, restricting or rerouting some or the entirety of a roadway or lane. Traffic barricades are classified into three main types by the Manual on Uniform Traffic Control Devices (MUTCD). These three main types of traffic barricades are used on conventional roads, are reflective for a highway environment, or for complete road closures. These traffic barricade can be places in specific areas where extra warning is needed or across general roadway areas to alert pedestrians or vehicles. Most traffic barricades are currently made of a molded plastic material which proved to be a great improvement over the conventional steel and wood type traffic barricades that were more commonly used many years ago. Although these molded plastic designs will cause less damage if accidently hit by a vehicle compared to the conventional steel and wood design, the molded plastic design are more susceptible to being moved or falling over by either wind or other unintentional forces. This requires the new molded plastic traffic barricade design to use sandbags or other heavy objects to hold the sign traffic barricade down.

An objective of the present invention is to provide users with a T-frame design traffic barrier, to help with create a sturdy traffic barricade design. The present invention intends to provide users with a device that can be folded for easy transportation and storage with additional features to provide a sturdy structure and an adjustable design. In order to accomplish that, a preferred embodiment of the present invention comprises a plurality of base legs, a plurality of vertical supports, and a plurality of chevron boards. Further, the plurality of base legs allows for the traffic barricade to be easily collapsible to easily transport or store the present invention. Thus, the present invention is an adjustable traffic barricade that utilizes a foldable design to achieve easier transportation and storage of the present invention without sacrificing sturdiness and durability.

SUMMARY OF THE INVENTION

The present invention is a traffic barricade with retractable base and upright members that can be interchangeable. The present invention seeks to provide users with a device can be easily folded into a smaller design to allow for easy transportation, storage, and traffic sign adjustability. In order to accomplish this the present invention comprises a plurality of base legs that provide a strong foundation utilizing a T-frame base.

Further, the plurality of vertical supports allows for the traffic barricade to be easily folded up into a small design that allows for easy transportation and storage. Additionally, plurality of chevron boards has a reflective material that indicate information to passing vehicles and pedestrians that can be changed and altered based on the particular traffic situation.

Thus, the present invention is an adjustable traffic barricade that utilizes a foldable design to achieve easier transportation and storage of the present invention without sacrificing sturdiness and durability.

DETAIL DESCRIPTIONS OF THE INVENTION

All illustrations of the drawings are for the purpose of describing selected versions of the present invention and are not intended to limit the scope of the present invention.

Figure 1:
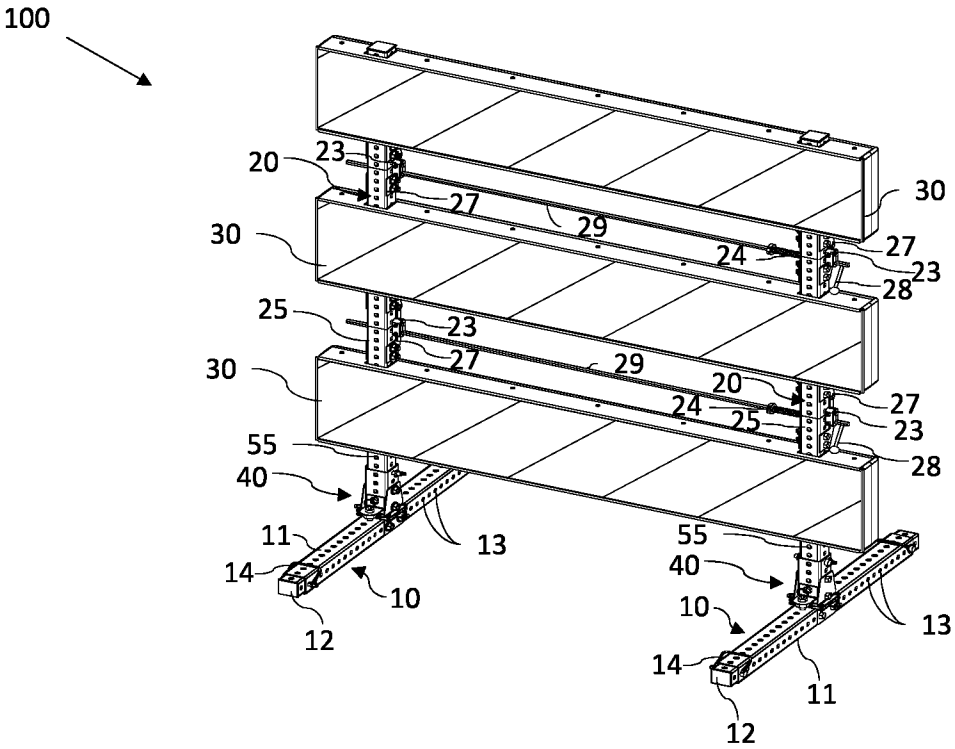
FIG. 1 is a perspective view of one embodiment of the present invention.

As shown in FIG. 1, the present invention is adjustable traffic barricade 100. An objective of the present invention is to provide users with a traffic barricade that comprises adjustable members to make a folded design that allows for easier transportation and storage.

To accomplish this the barricade 100 of the present invention comprises a plurality of base legs 10, a plurality of vertical supports 20, and a plurality of chevron boards 30. Many of these components of the present invention allow for the user to adjust the instructions the traffic barricade communicates to passing vehicles and pedestrians.

The plurality of base legs 10 forms perpendicular angle with the plurality of vertical supports 20 to create a T-frame design. Along the plurality of vertical supports 20 the plurality of chevron boards 30 are attached to create perpendicular angles. The pivot connections of the plurality of base legs allows the present invention to be folded up. Thus, the present invention is an adjustable traffic barricade 100 that utilizes a foldable design to achieve easier transportation and storage of the present invention without sacrificing sturdiness and durability.

The present invention is supported by the plurality of base legs 10. The plurality of base legs 10 is made of a lightweight metal material with a rectangular shaft design that allows for easy relocation while still providing a durable and stable design.

In its preferred embodiment, the plurality of base legs 10 comprises a plurality of pivot connections 40. In some embodiments, the plurality of base legs 10 can also include a spring mechanism, and any lock known in the art.

Figure 2:
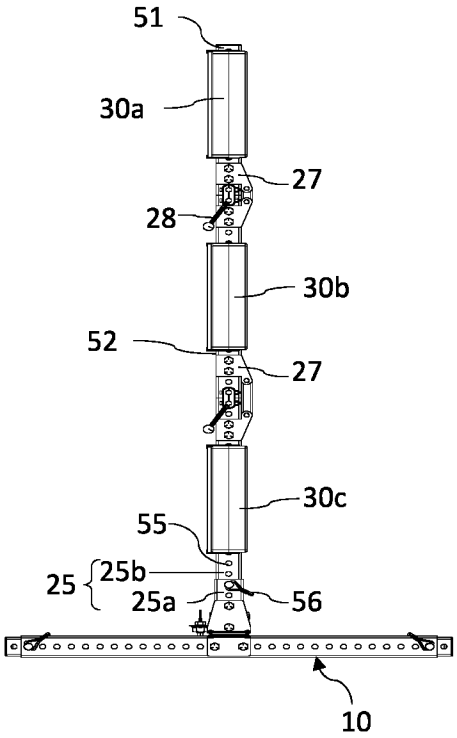
FIG. 2 is a sideview of one embodiment of the present invention.
Figure 3:
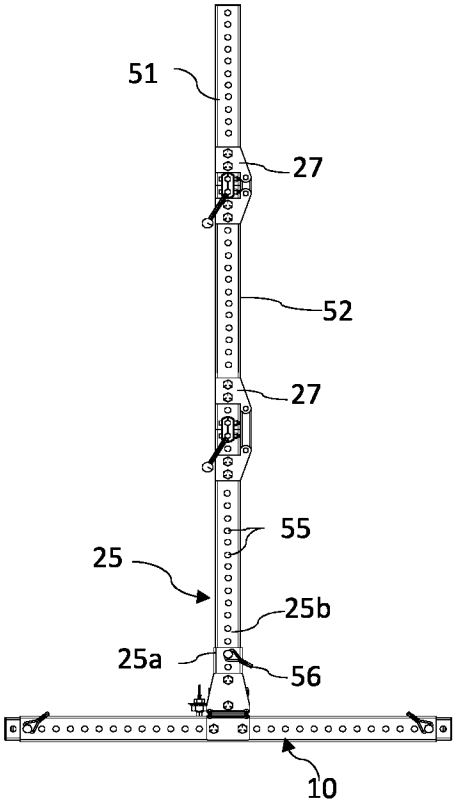
FIG. 3 is a sideview of one embodiment of the present invention without chevron boards.
Figure 6:
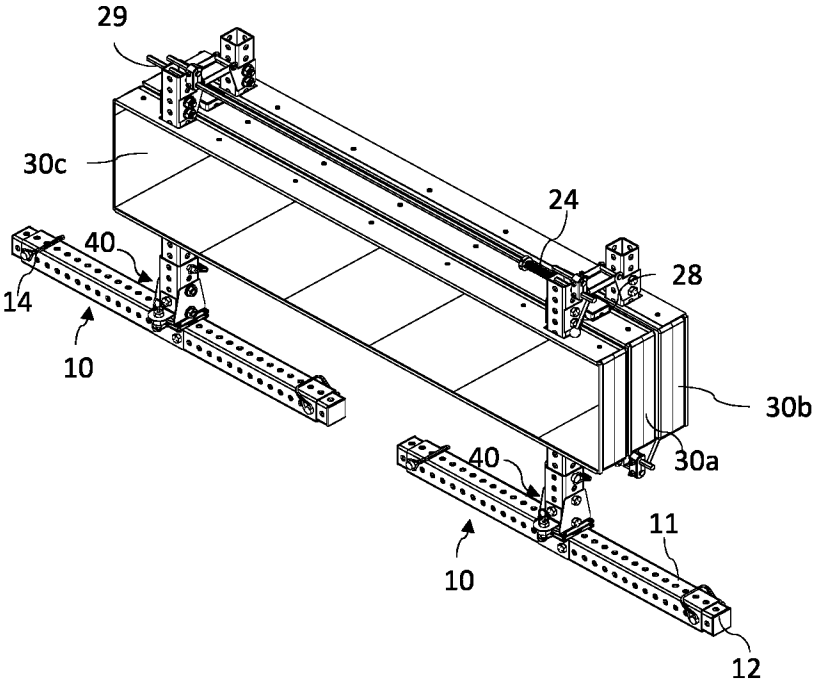
FIG. 6 is an illustration of one embodiment of the present invention in a folded state.
Figure 7:
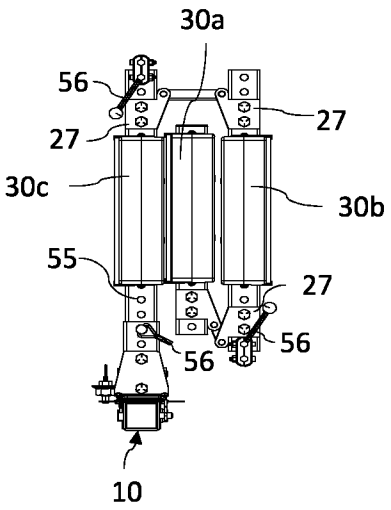
FIG. 7 is a sideview of one embodiment of the present invention in a folded state.

The plurality of pivot connections 40 can be located at the base of the present invention in the middle of the plurality of base legs 10 as seen in FIGS. 1 to 3. The plurality of pivot connections 40 can be made of a similar lightweight metal material and design to allow for rotational movement. This design allows for the plurality of base legs 10 to be turned 90 degrees in either direction to create a flat folded design (as shown in FIG. 6 and FIG. 7) when the present invention needs to be stored.

Once the plurality of base legs 10 is folded into place for storage, the lock may engage with the plurality of base legs 10. This design ensures that once the plurality of base legs 10 is folded, they will not swing back open when the present invention is being moved unless the user needs the plurality of base legs 10 to be unlocked again.

To ensure the plurality of base legs 10 can easily move back into place, in some embodiments, the present invention can include a spring mechanism know in the art to create a rotational force on the plurality of base legs 10, pushing the plurality of base legs 10 back into place.

In some embodiments, the barricade 100 of the present invention may include at least two base legs 10 that include an outer member 11 and an inner member 12 where the inner member 12 is displaceably arranged within the outer member 11 so that the inner member 12 can be moved along the longitudinal axis of the outer member 11.

In some embodiments, the at least two base legs 10 of the barricade 100 may include a holding mechanism for limiting displacement of the inner member 12 relative to the outer member 11 and the holding mechanism can be a plurality of locking holes 13 placed on the base legs 10 and a locking pin 14.

It should be further noted that, the plurality of base legs 10 can be created in many various shapes and sizes and the lock for locking the base legs 10 can be utilized in various ways while still staying within the scope of the present invention.

The plurality of vertical supports 20 connects with the plurality of base legs 10 via the pivot connections 40 of the plurality of base legs 10.

The plurality of vertical supports 20 can be designed with a similar rectangular shaft design as the plurality of base legs 10 with a similar lightweight metal material.

In preferred embodiment, the plurality of vertical supports 20 comprises a plurality of hinges 27, a telescopic base 25, and a hinge release lever 28. The hinges 27 can be fastened to the barricade 100 via any known fasteners such as screws.

In some embodiments, the hinge release lever 28 is connected to a bar 29 with a spring 24 and one or more stoppers 23 to lock the vertical supports 20.

The plurality of hinges 27 can be positioned any suitable place including along the front and rear sides of the plurality of vertical supports 20 and allow for 180 degrees of motion. This design allows for the traffic barricade 100 to fold as seen in FIG. 6 and FIG. 7.

The telescopic base 25 can be located at the base of the plurality of vertical supports 20. The telescopic base allows the plurality of vertical supports 20 to extend or retract allowing the overall height of the traffic barricade 100 to either increase or decrease depending on the required situation.

In some embodiments, the telescopic base 25 may be a hollow tube and may utilize a similar shaft cross sectional area that is slightly larger than the cross-sectional area of the plurality of vertical supports 20 that allows the vertical supports 20 to move in and out of the hollow tube (telescopic base 25).

To increase convenience and ease of use for the user the plurality of vertical supports 20 is equipped with a hinge release lever 28. When the plurality of vertical supports 20 is in the upright position the plurality of hinges 27 is locked in a straight position. In order to allow the plurality of vertical supports 20 to fold up the hinge release lever 28 must be activated. The hinge release lever 28 (which is connected to the bar 29 with a spring 24 and one or more stoppers 23) can be pulled and the plurality of hinges 27 can be unlocked, allowing for the plurality of vertical supports 20 to move into a folded position seen in FIGS. 6 and 7.

In some embodiments, the barricade 100 may include at least two vertical supports 20 spaced apart with respect to each other, the at least two vertical supports 20 each having a top and bottom distal end.

In such embodiments, the at least two vertical supports 20 may include a first section 51, a second section 52, a telescopic base 25. Each of the first section 51, the second section 52 and the telescopic base 25 may include a top surface and a bottom surface.

The telescopic base 25 can be hingedly connected to the second section 52 of the at least two of the vertical supports 20 and, as shown in FIG. 2, the telescopic base 25 may comprise a first telescopic member 25*a* and a second telescopic member 25*b*, where the second telescopic member 25*b* is displaceably arranged within the first telescopic member 25*a* so that the second telescopic member 25*b* can be moved in a first and a second axial direction along the longitudinal axis of the first telescopic member 25*a*.

In some embodiments, the barricade 100 may include a holding mechanism for limiting displacement of the second telescopic member 25*b* relative to the first telescopic member 25*a*, the holding mechanism can be a plurality of locking holes 55 placed on the vertical supports 20 and a locking pin 56.

The second section 52 of the at least two vertical supports 20 may be hingedly connected to the first section 51, such that the first section 51 and the second section 52 can hingedly fold between an unfolded position and a folded position. At the unfolded position, the top surface of the first section 51, the top surface of the second section 52 and the top surface of the telescopic base 25 may form a continuous upper surface having a generally straight line profile.

At the folded position, the bottom surface of the first section 51 directly overlays the bottom surface of the second section 52 and the top surface of the first section 51 directly overlays the bottom surface of the telescopic base 25.

In some embodiments, the first section 51 and second section 52 of the at least two vertical supports 20 may also include a plurality of locking holes 55.

In some embodiments, the at least two base legs 10 can be pivotally mounted to the bottom distal end of the at least two of the vertical supports 20.

The plurality of chevron boards 30 connects with the plurality of vertical supports 20 with at a perpendicular angle shown in FIG. 1. For example, the plurality of chevron boards 30 may extend perpendicularly from one of the at least two vertical supports 20 to one of the at least two vertical supports 20.

In some embodiments, the plurality of chevron boards 30 includes a front and rear side and the front or rear side may include reflective material.

In some embodiments, the first section 51 of the vertical support 20 may include a first chevron board 30*a* and the second section 52 of the vertical support 20 may include a second chevron board 30*b*. The telescopic base 25 may include a third chevron board 30*c* as shown in FIG. 2.

At the unfolded position, the front side of the first chevron board 30*a*, the front side of the second chevron board 30*b* and the front side of the third chevron board 30*c* may form a continuous upper surface having a generally straight line profile.

At the folded position, the rear side of the first chevron board 30*a* may directly overlay the rear side of the second chevron board 30*b* and the front side of the first chevron board 30*a* may directly overlay the rear side of the third chevron board 30*c*.

In some embodiments, the at least two base legs 10 can be pivotally mounted to the bottom distal end of the at least two of the vertical supports 20.

Figure 4:
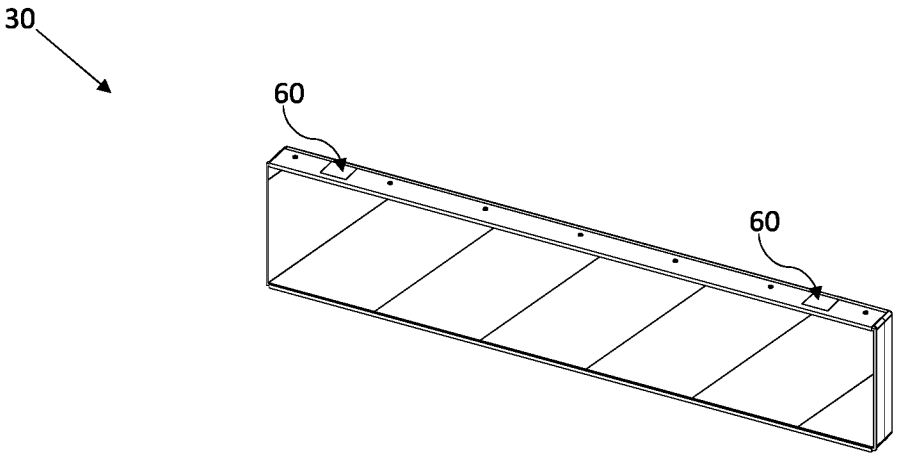
FIG. 4 an illustration showing one embodiment of the chevron board of the present invention.

In some embodiments, as shown in FIG. 4, the plurality of chevron boards 30 can include a plurality of connecting holes 60 for connecting the chevron boards 30 to the at least two vertical supports 20. The plurality of chevron boards 30 can be fastened to the at least two vertical supports 20 via fasteners such as sheet metal screws or any other known fasteners inserting through fastening holes that may be provided in the chevron boards 30.

The plurality of chevron boards 30 can be created with a lightweight, durable plastic material to provide longevity without sacrificing ease of use.

Figure 5:
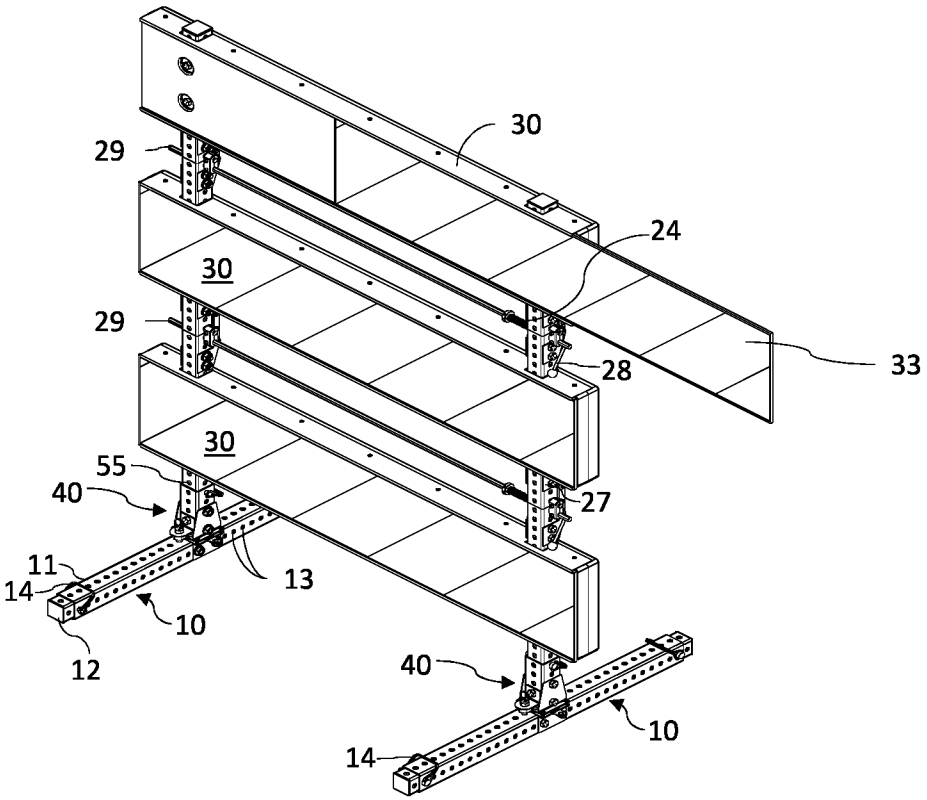
FIG. 5 is an illustration of one embodiment of the present invention showing a board tab slidably attached to the chevron board.

In preferred embodiment, the plurality of chevron boards 30 comprises a plurality of reflective material and a plurality of board tabs 33 that can be slidably attached to the chevron boards 30 as shown in FIG. 5.

The plurality of reflective material is designed with a plastic highly reflective material with a preferable orange color. The plurality of reflective material is not limited to an orange color but is designed to alert passing vehicles and pedestrians of potential hazards and roadway changes. The plurality of reflective material usually is four sided shapes that point into a certain direction to indicate what the oncoming vehicle should do or expect. In other traffic barricade designs the plurality of reflective material is fixed, limiting the user to one type of warning.

The plurality of board tabs 33 can be placed on the chevron boards 30 and configured to be moved along the horizontal axis of the chevron boards 30, resulting in a change of the angle of the plurality of reflective material. This design allows the plurality of reflective material to be adjusted in various ways to create many different warnings for passing vehicles and pedestrians. With all the components working in tandem with each other it can be seen that the present invention is an adjustable traffic barricade 100 that utilizes a foldable design to achieve easier transportation and storage of the present invention without sacrificing sturdiness and durability.

Although the invention has been explained in relation to its preferred embodiment, it is to be understood that many other possible modifications and variations can be made without departing from the spirit and scope of the invention.

What is claimed is:

1. A barricade comprising:

at least two vertical supports spaced apart with respect to each other, the at least two vertical supports each having a top and bottom distal end, the at least two vertical supports including:

a first section;

a second section;

a telescopic base;

each of the first section, the second section and the telescopic base having a top surface and a bottom surface;

the telescopic base hingedly connected to the second section, the telescopic base comprising a first telescopic member and a second telescopic member, where the second telescopic member is displaceably arranged within the first telescopic member so that the second telescopic member can be moved in a first and a second axial direction along the longitudinal axis of the first telescopic member, and a holding mechanism for limiting displacement of the second telescopic member relative to the first telescopic member, the holding mechanism includes a plurality of locking holes placed on the at least two vertical supports and a locking pin;

the second section hingedly connected to the first section, such that the first section and the second section can hingedly fold between an unfolded position and a folded position, wherein at the unfolded position, the top surface of the first section, the top surface of the second section and the top surface of the telescopic base form a continuous upper surface having a generally straight line profile, and at the folded position, the bottom surface of the first section directly overlays the bottom surface of the second section and the top surface of the first section directly overlays the bottom surface of the telescopic base;

a hinge release lever attached to a bar extending perpendicularly from one of the at least two vertical supports to one of the at least two vertical supports; and at least two base legs pivotally mounted to the bottom distal end of the at least two of the vertical supports.

2. The barricade as claimed in claim 1, wherein the barricade includes a plurality of chevron boards extending perpendicularly from one of the at least two vertical supports to one of the at least two vertical supports.

3. The barricade as claimed in claim 2, wherein the plurality of chevron boards includes a front and rear side, the front or rear side including reflective material.

4. The barricade as claimed in claim 2, wherein the plurality of chevron boards includes a plurality of board tabs slidably attached to the chevron boards.

5. The barricade as claimed in claim 1, wherein the at least two base legs include an outer member and an inner member where the inner member is displaceably arranged within the outer member so that the inner member can be moved along the longitudinal axis of the outer member.

6. The barricade as claimed in claim 5, wherein the at least two base legs include the holding mechanism for limiting displacement of the inner member relative to the outer member.

7. The barricade as claimed in claim 6, wherein the holding mechanism includes a plurality of locking holes placed on at least two base legs and the locking pin.

8. A barricade comprising:

at least two vertical supports spaced apart with respect to each other, the at least two vertical supports each having a top and bottom distal end, the at least two vertical supports including:

a first section;

a second section;

a telescopic base;

each of the first section, the second section and the telescopic base having a top surface and a bottom surface;

the telescopic base hingedly connected to the second section, the telescopic base comprising a first telescopic member and a second telescopic member, where the second telescopic member is displaceably arranged within the first telescopic member so that the second telescopic member can be moved in a first and a second axial direction along the longitudinal axis of the first telescopic member, and a holding mechanism for limiting displacement of the second telescopic member relative to the first telescopic member;

the second section hingedly connected to the first section, such that the first section and the second section can hingedly fold between an unfolded position and a folded position, wherein at the unfolded position, the top surface of the first section, the top surface of the second section and the top surface of the telescopic base form a continuous upper surface having a generally straight line profile, and at the folded position, the bottom surface of the first section directly overlays the bottom surface of the second section and the top surface of the first section directly overlays the bottom surface of the telescopic base; and at least two base legs pivotally mounted to the bottom distal end of the at least two of the vertical supports.

9. The barricade as claimed in claim 8, wherein the holding mechanism includes a plurality of locking holes placed on at least two vertical supports and a locking pin.

10. The barricade as claimed in claim 8, wherein the plurality of chevron boards includes a plurality of board tabs slidably attached to the chevron boards.

11. The barricade as claimed in claim 8, wherein the at least two base legs include an outer member and an inner member where the inner member is displaceably arranged within the outer member so that the inner member can be moved along the longitudinal axis of the outer member.

12. The barricade as claimed in claim 11, wherein the at least two base legs include a holding mechanism for limiting displacement of the inner member relative to the outer member.

13. The barricade as claimed in claim 12, wherein the holding mechanism includes a plurality of locking holes placed on at least two base legs and a locking pin.

14. A barricade comprising:

at least two vertical supports spaced apart with respect to each other, the at least two vertical supports each having a top and bottom distal end, the at least two vertical supports including:

a first section;

a second section;

a telescopic base;

each of the first section, the second section and the telescopic base having a top surface and a bottom surface;

the telescopic base hingedly connected to the second section, the telescopic base comprising a first telescopic member and a second telescopic member, where the second telescopic member is displaceably arranged within the first telescopic member so that the second telescopic member can be moved in a first and a second axial direction along the longitudinal axis of the first telescopic member, and a holding mechanism for limiting displacement of the second telescopic member relative to the first telescopic member;

the second section hingedly connected to the first section, such that the first section and the second section can hingedly fold between an unfolded position and a folded position, wherein at the unfolded position, the top surface of the first section, the top surface of the second section and the top surface of the telescopic base form a continuous upper surface having a generally straight line profile, and at the folded position, the bottom surface of the first section directly overlays the bottom surface of the second section and the top surface of the first section directly overlays the bottom surface of the telescopic base;

at least two base legs pivotally mounted to the bottom distal end of the at least two of the vertical supports; and a plurality of chevron boards extending perpendicularly from one of the at least two vertical supports to one of the at least two vertical supports.

15. The barricade as claimed in claim 14, wherein the plurality of chevron boards includes a front and rear side, the front or rear side including reflective material.

16. The barricade as claimed in claim 15, wherein the first section includes a first chevron board, the second section includes a second chevron board, and the telescopic base includes a third chevron board.

17. The barricade as claimed in claim 16, wherein at the unfolded position, the front side of the first chevron board, the front side of the second chevron board and the front side of the third chevron board form a continuous upper surface having a generally straight line profile, at the folded position, the rear side of the first chevron board directly overlay the rear side of the second chevron board and the front side of the first chevron board directly overlay the rear side of the third chevron board.

18. The barricade as claimed in claim 17, wherein the at least two base legs include an outer member and an inner member where the inner member is displaceably arranged within the outer member so that the inner member can be moved along the longitudinal axis of the outer member.

* * * * *